US005977461A

United States Patent [19]

Lin

[11] Patent Number: 5,977,461

[45] Date of Patent: Nov. 2, 1999

[54] TRANSMISSION STRUCTURE FOR DECORATIVE OBJECTS

[76] Inventor: Hsi-Chun Lin, P.O. Box 96-405, Taipei 10098, Taiwan

[21] Appl. No.: 08/937,293

[22] Filed: Sep. 27, 1997

[51] Int. Cl.[6] ..... G10F 1/06

[52] U.S. Cl. ..... 84/95.2; 472/6; 40/411

[58] Field of Search ..... 84/94.1, 94.2, 84/95.1, 95.2; 472/6, 12; 446/236; 40/410, 411, 414, 423; 74/50, 411, 640

[56] References Cited

U.S. PATENT DOCUMENTS

| | | | |
|---|---|---|---|
| 2,457,447 | 12/1948 | Cohn | 272/31 |
| 2,881,001 | 4/1959 | Chisholm et al. | 272/31 |
| 3,948,209 | 4/1976 | Takemoto et al. | 116/124.4 |
| 4,983,890 | 1/1991 | Satoh et al. | 318/3 |
| 5,179,796 | 1/1993 | Gephart, Jr. | 40/473 |
| 5,336,133 | 8/1994 | Chen | 472/6 |
| 5,430,239 | 7/1995 | Chen | 84/95.2 |
| 5,675,921 | 10/1997 | Lin | 40/409 |
| 5,701,785 | 12/1997 | Liu | 74/421 R |
| 5,705,759 | 1/1998 | DeVivo | 84/95.2 |

*Primary Examiner*—Robert E. Nappi
*Assistant Examiner*—Wesley Scott Ashton
*Attorney, Agent, or Firm*—Dougherty & Troxell

[57] ABSTRACT

A transmission for a decorative object having a music unit and a supporting frame mounted over the music unit, a plurality of spindles mounted between the supporting frame and the music unit and a plurality of gears mounted on the spindles and engaged with one another. A top of the supporting frame has a flat side with a center spindle hole for receiving a spindle, which extends through the spindle hole and is attached to a first rotary disk. One spindle is coupled with an inner gear of a ring unit by a transmission gear, a lower part of the ring unit being connected with an upper edged of a second rotary disk. When the music unit rotates the spindles on the supporting frame, the decorative objects attached to the rotary disks move simultaneously.

4 Claims, 5 Drawing Sheets

TRANSMISSION STRUCTURE FOR DECORATIVE OBJECTS

BACKGROUND OF THE INVENTION

1. Field of the Invention

This invention relates to a transmission, and particularly to a transmission that can drive a decorative object or objects by means of a music unit.

2. Description of the Prior Art

In a conventional transmission for decorative objects, such as U.S. Pat. No. 5,555,656, it comprises a music unit, of which the tail end of a transmission shaft is mounted with a gear to be engaged with a ring gear of a rotary disk such that, when the music unit turns, the rotary disk will be driven.

In another conventional transmission for decorative objects, such as U.S. Pat. No. 5,088,218, its music unit has a driving gear engaged with a crown gear, of which the spindle extends upwards to a connecting rod and a disk having decorative objects. When the disk is turned, the decorative objects thereon will move.

SUMMARY OF THE INVENTION

The prime object of the present invention is to provide a transmission for decorative objects, in which the top of the music unit has a supporting frame and a plurality of spindles extend between the supporting frame and the music unit. The spindles are coupled to each other by means of gears. The top of the supporting frame has a flat side with a center spindle hole for receiving a spindle, which extends through the spindle hole to be mounted with a rotary disk. A spindle beside the center spindle has a transmission gear engaged with an inner gear of a ring unit. The lower part of the ring unit is connected with the upper edge of the rotary disk. When the music unit turns the spindles on the supporting frame, the decorative objects on the rotary disk and the decorative objects on the rotary disk under the ring unit will move synchronously.

Another object of the present invention is to provide a transmission for decorative objects, in which the spindle of a crown gear engaged with the driving gear of the music unit is pivotally mounted in a spindle hole in the supporting frame. The mid-portion of the spindle has a longitudinally ridged surface to engage with a cylindrical hole of the transmission gear. A round shaft on the lower part thereof is mounted in a cylindrical hole of the crown gear, while the short post on an end thereof is mounted and riveted with a positioning disk. The crown gear on the spindle is engaged with the driving gear of the music unit. Thus, the transmission gear can move the decorative objects on the outer transmission.

Still another object of the present invention is to provide a transmission for decorative objects, in which the spindle of the crown gear is engaged with the driving gear of the music unit, and the longitudinally ridged surface on the spindle is pressed into the cylindrical hole of transmission gear. The round shaft of the spindle extends through the cylindrical hole of the crown gear, while the end of the spindle is connected and riveted with a positioning disk in a flexible manner. The crown gear and the transmission gear are assembled together by means of the coupling force of the positioning disk riveted in place. When the decorative objects on the rotary disk are hindered with a resistance which is higher than the coupling force between the crown gear and the gear assembly, the contact surface between the crown gear and the gear assembly will slide without causing any damage to the crown gear.

A further object of the present invention is to provide a transmission for decorative objects, in which the supporting frame mounted over the music unit has a flat side with a center spindle hole for receiving a spindle with a drive gear. Around the center spindle hole, there is a contact flange, which is in contact with the bottom of a rotary disk so as to reduce the friction area between the rotary disk and the flat side.

Still a further object of the present invention is to provide a transmission for decorative objects, in which the transmission gear of the spindle engages an inner gear in the ring unit. The lower side of the ring unit is mounted on the top edge of the base. The outer edge of the rotary disk has a ring plate, and the inner surface thereof has a ring flange mounted on the top edge of the base. The top edge of the ring flange is mounted with the positioning ring of a positioning disk. Thus, when the music unit rotates, the transmission gear on the spindle will turn the ring unit and also turn the decorative objects on the ring plate of the rotary disk.

DETAILED DESCRIPTION OF THE PREFERRED EMBODIMENT

Figure 1:
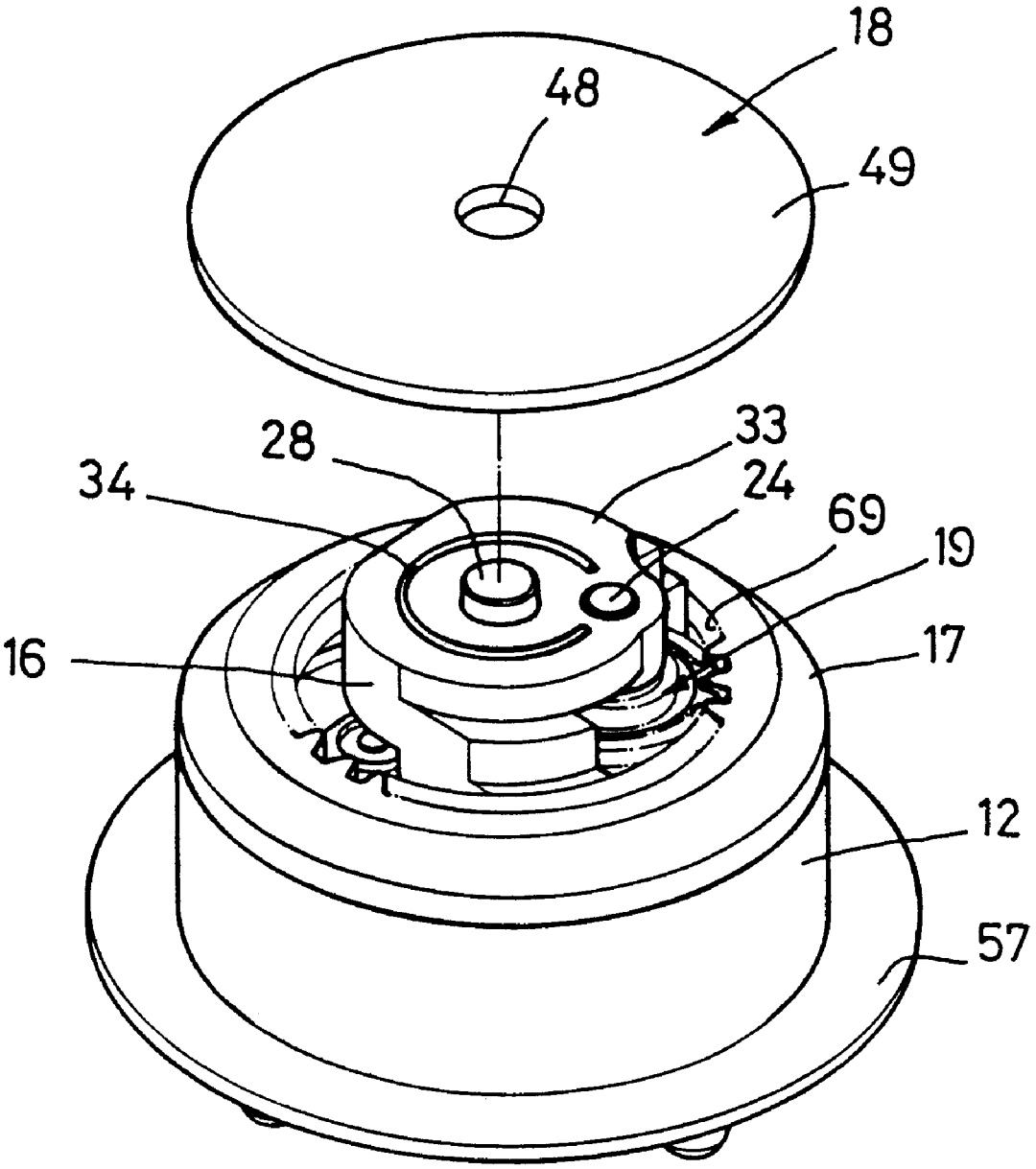
FIG. 1 is a perspective view of the present invention, showing the transmission thereof.
Figure 2:
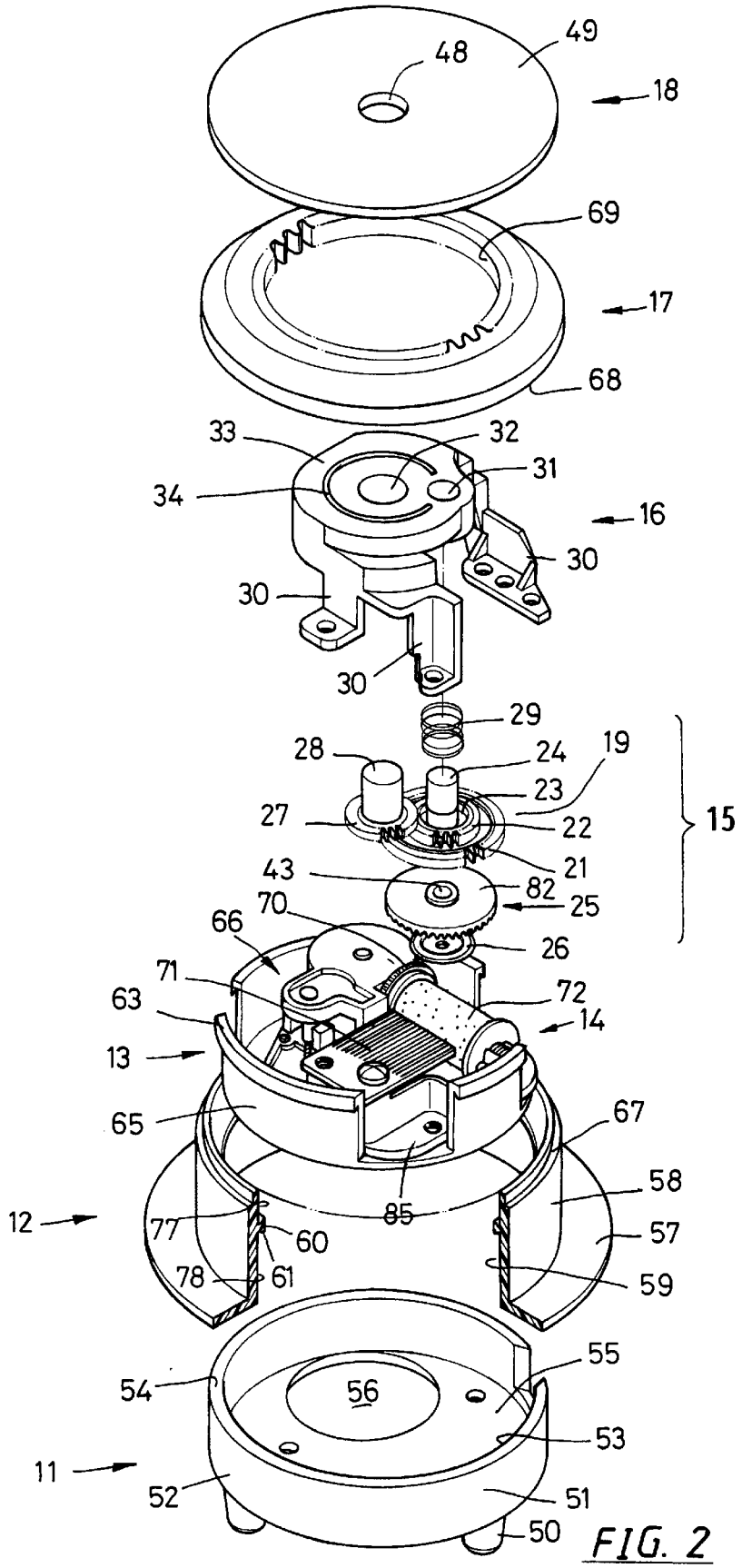
FIG. 2 is an exploded perspective view of the present invention, showing the various parts of the transmission thereof.

Referring to FIGS. 1 and 2, this invention relates to a transmission assembly 15 for a music unit, which can synchronously turn two rotary disks 12 and 18 each having decorative objects. The transmission assembly 15 comprises spindles 24 and 28 mounted in two spindle holes 31 and 32 respectively on a supporting frame 16, which is fixed on a base of the music unit 14. When the music unit 14 rotates, the driving gear 70 thereof will turn a crown gear 25 on the spindle 24. Then, two transmission gears 21 and 22 on the spindle 24 will rotate, causing the two transmission gears 21 and 22 on the spindle 24 to drive an inner gear 69 of a ring unit 17 and a driven gear 27 on the center spindle 28 to rotate, so as to rotate a decorative object on an upper rotary disk 1 8 and an edge rotary disk 12 on the supporting frame 16.

Figure 3:
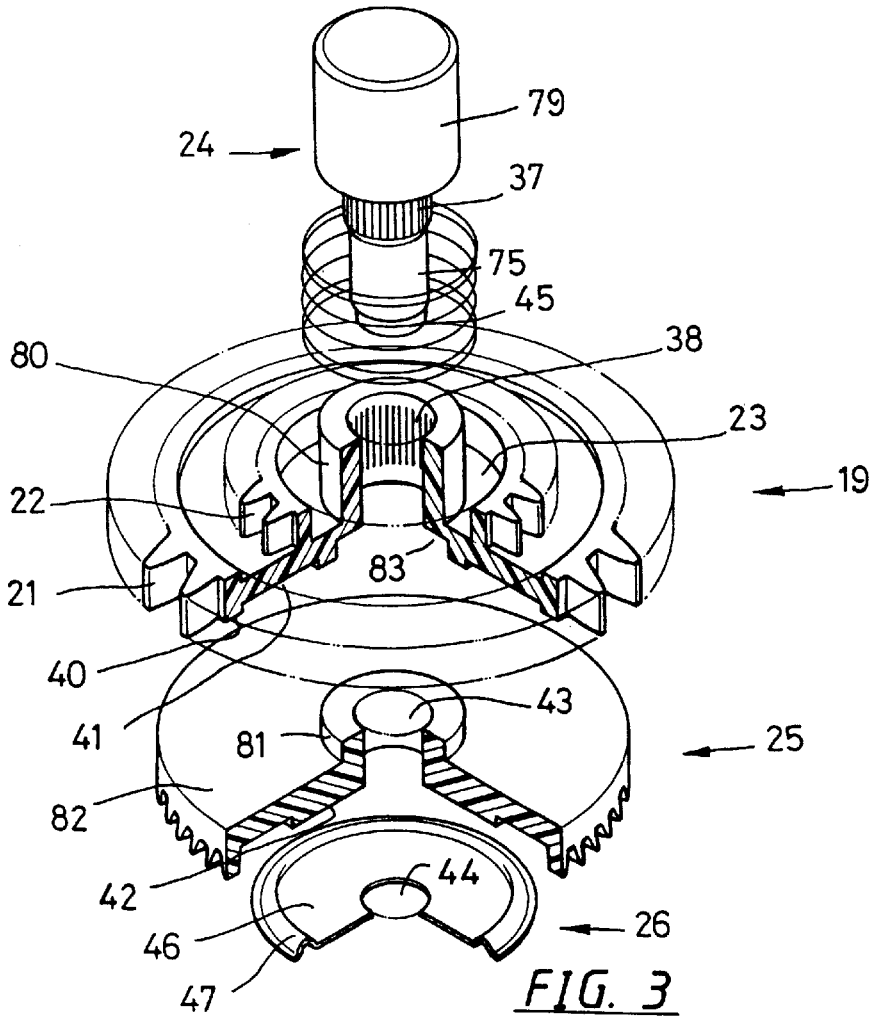
FIG. 3 is a fragmental, exploded perspective view of the present invention, showing the relation between the crown gear and the spindle thereof.
Figure 6:
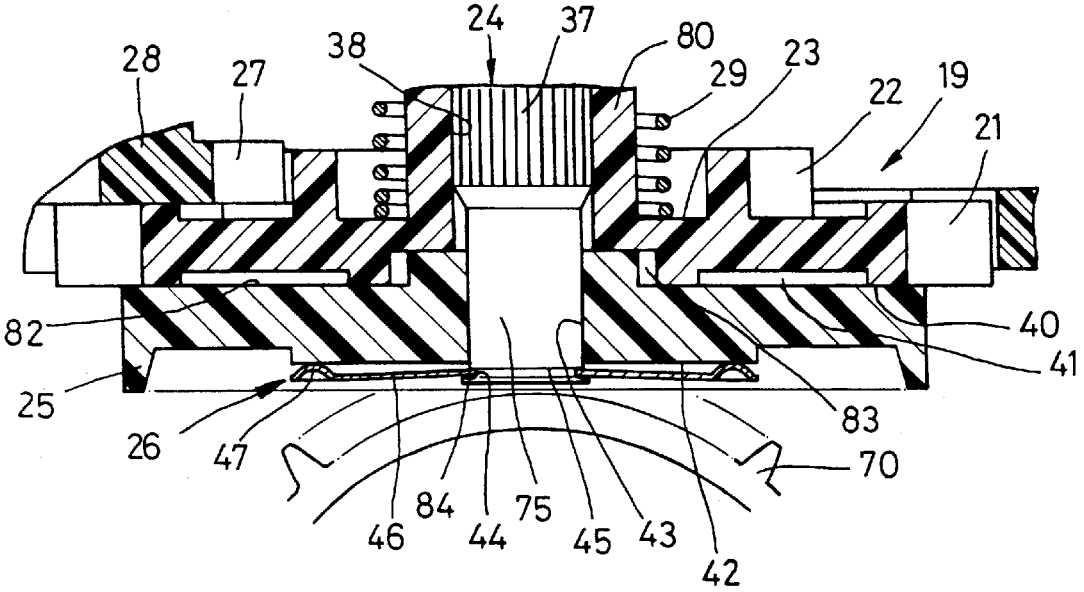
FIG. 6 is a partial, sectional view of the present invention, showing the relation between the ring unit and the rotary disk thereof.
Figure 4:
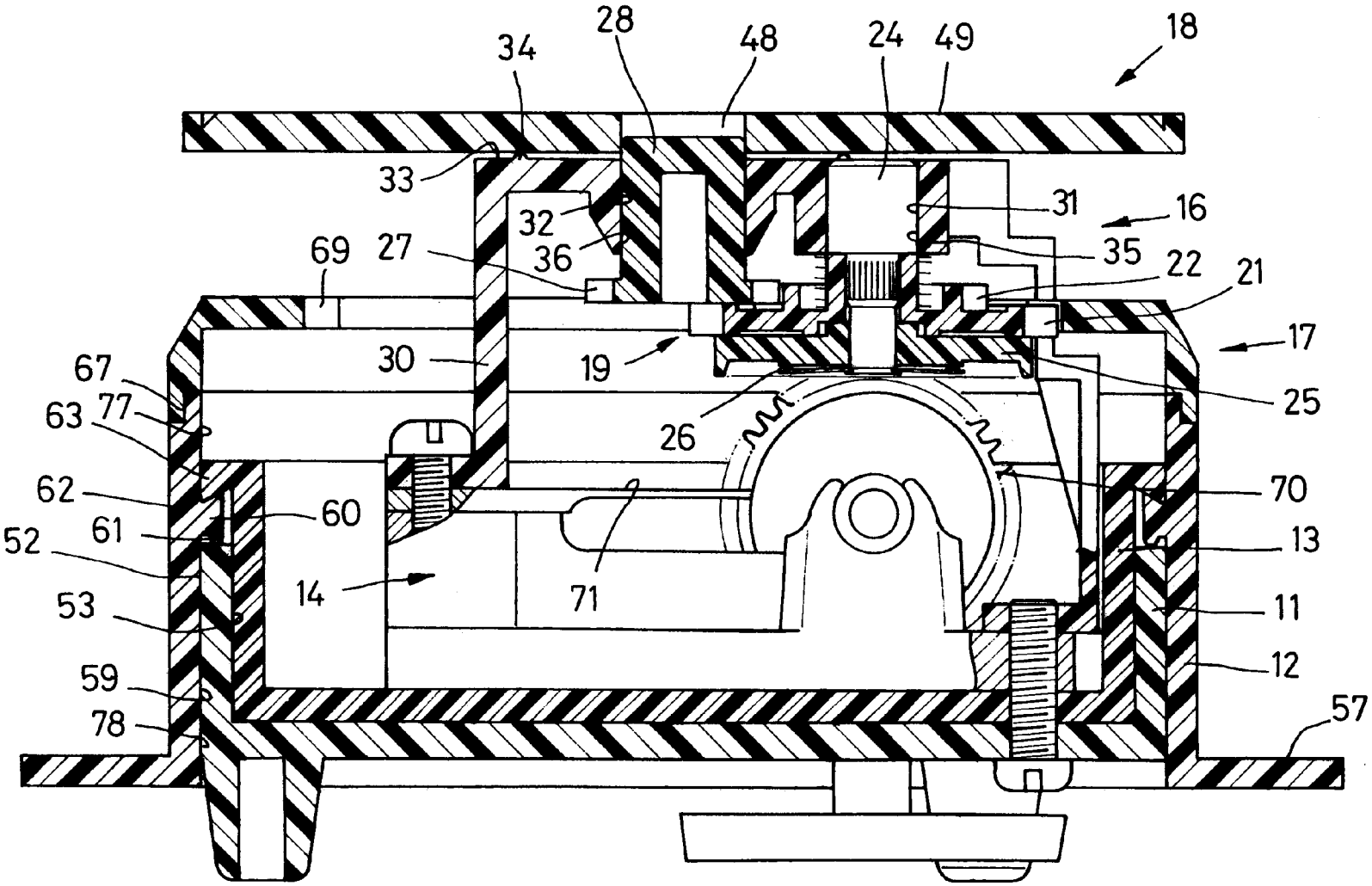
FIG. 4 is a sectional view of the present invention, showing the transmission thereof.

Referring to FIGS. 2 to 4, the edge rotary disk 12 extends around and is mounted on the base 11. The bottom of the base 11 has a plurality of support legs 50 for providing a balanced support to the decorative objects and the transmission. The base 11 has cylindrical part 51, of which the top edge 54 is engaged by a flange 60 of the edge rotary disk 12. The inside of the cylindrical part 51 is a hollow space. The flat bottom 55 of the base has a round hole 56. The edge rotary disk 12 has a cylindrical part 58 to enable the disk 12 to enclose the base 11. The edge rotary disk 12 has an inner surface 59 which is slightly larger than the cylindrical part 51 of the base 11. A ring flange 60 extends from the inner surface 59 to divide the inner surface into two portions, i.e., an upper surface 77 and a lower surface 78. The ring flange 60 has a suitable thickness and an inner diameter equal to or slightly larger than that of the inner surface 53 of the cylindrical part 51 of the base 11. The lower surface 78 of the inner surface 59 has a height larger than that of the cylindrical part 51. After the cylindrical part 58 of the edge rotary disk 12 is mounted on the outer surface 52 of the base 11, the ring contact surface 61 of the ring flange 60 will be in contact with the top edge 54 of the base 11. The top side of the ring flange 60 has a limit ring surface 62 between the ring flange 60 and the upper surface 77 to locate thereon a positioning ring 63 on the cylinder part 65 of the positioning disk 13 such that the rotary disk 12 is held between the base 11 and the positioning disk 13. The bottom edge of the cylindrical part 58 has a ring plate 57 with a suitable width so as to mount a decorative object thereon.

The positioning disk 13 above the inner surface 59 of the rotary disk 12 has a cylindrical part 65 at a suitable height and the bottom thereof has a flat side in contact with a flat bottom 55 of the base 11. In the center thereof, there is a recessed space 66 for mounting the music unit 14. The diameter of the cylindrical part 65 of the positioning disk 13 is equal to or slightly smaller than that of the inner surface 53 of the base 11. After the positioning disk 13 is mounted on the base 11, the ring flange 60 on the inner surface 59 of the rotary disk 12 will be held between the top edge 54 of the base 11 and the positioning ring 63 of the positioning disk 13. The music unit 14 is fastened, with a screw, in the recessed space 66 in the positioning disk 13 so as to have the base 11, the rotary disk 12 and positioning disk 13 assembled together.

The upper edge of the cylindrical part 58 of the rotary disk 12 has a cascade ring 67 assembled with a ring unit 17 having inner gear 69. The ring surface 68 of the ring unit 17 has a cascade ring mated with the cascade ring 67 of the rotary disk 12. After the two cascade rings are engaged together, they will be held together by means of supersonic welding, or by means of a glue. Before the ring unit 17 is assembled, the music unit 14 and the transmission assembly 15 are mounted in the recessed space 66 in the positioning disk 13. After the ring unit 17 and the rotary disk 12 are assembled together, the inner gear 69 of the ring unit 17 will be engaged with a transmission gear 21 of the transmission assembly 15.

The music unit 14 mounted in the recessed space 66 of the positioning disk 13 includes a plurality of music reeds 71 and a music drum 72 fastened on a seat 85. One end of the music drum 72 has a driving gear 70. The music drum 72 and the driving gear 70 are mounted on one spindle. By means of engagement between the driving gear 70 and the crown gear 25 of the transmission assembly 15, the decorative objects mounted outside can simultaneously move when the music drum 72 drives the music reeds 71 to generate a music.

Referring to FIGS. 2 to 6, the transmission assembly 15 must be assembled in place before the music unit 14 is fastened in the recessed space 66 of the positioning disk 13. The transmission assembly 15 above the music unit 14 includes a supporting frame 16 with support arms 30, which are fastened to the seat 85 to locate the transmission assembly 15 over the music unit 14. The top of the supporting frame 16 has a flat side 33, a center spindle hole 32, and an eccentric spindle hole 31. Each spindle hole includes a cylindrical surface 36 and 35 for receiving the two spindles 28 and 24, respectively. The spindle 28 extends into the center spindle hole 32, the top end of the spindle 28 mounted to a rotary disk 18, while the other end thereof has a driven gear 27 engaged with the transmission gear 22 of spindle 24.

The spindle 24 is mounted between the music unit 14 and the supporting frame 16 and is furnished with a cylindrical rod 79, below which a surface 37 with longitudinal ridges is provided. Below the longitudinally ridged surface 37, there is a cylindrical shaft 75 having a short post 45 under the cylindrical shaft 75. The diameter of the cylindrical rod 79 on the spindle 24 is equal to or slightly smaller than that of the eccentric spindle hole 31. The round cylindrical rod 79 is rotatably mounted in the spindle hole 31. The longitudinally ridged surface 37 under the cylindrical rod 79 of the spindle 24 is pressed and fastened into a cylindrical hole 38 in the gear assembly 19. The cylindrical shaft 75 under the longitudinally ridged surface 37 is mounted in a cylindrical hole 43 in the center of the crown gear 25. The end of the cylindrical shaft 75 has a short post 45 mounted in a positioning disk 26, to attach the crown gear 25 and the positioning disk 26 to the lower end of the spindle 24.

The gear assembly 19, assembled with spindle 24, includes two different transmission gears 21 and 22 in terms of tooth numbers. The second transmission gear 22 is mounted above the first transmission gear 21 and engages the driven gear 27 on the lower end of the spindle 28. The bottom surface 40 of the first transmission gear 21 has a ring groove 41. The top side of the second transmission gear 22 has a groove 23 located between the cylindrical sleeve 80 and the edge thereof. The diameter of the cylindrical sleeve 80 is the same as that of the cylindrical rod 79 of the spindle 24. The center cylindrical hole 38 of the gear assembly 19 has a second longitudinally ridged surface engaged with the longitudinally ridged surface 37 of the spindle 24 by using a press force.

The diameter of the cylindrical shaft 75 under the longitudinally ridged surface 37 is equal to or slightly smaller than that of the cylindrical hole 43 of the crown gear 25. The cylindrical sleeve 81 of the center cylindrical hole 43 in the crown gear 25 is higher than the flat side 82 of the crown gear 25. After the crown gear 25 and the cylindrical shaft 75 of the spindle 24 are connected together, the top side of the crown gear 25 will be in close contact with the bottom surface 40 under the gear assembly 19 and the top side of the cylindrical sleeve 81 will be in close contact with the ring recess 83 of the gear assembly 19.

The cylindrical shaft 75 of the spindle 24 has a short post 45, of which the diameter is slightly smaller than that of the cylindrical shaft 75. The short post 45 has a recessed part to be engaged with the round hole 44 of the positioning disk 26 to locate the positioning disk 26 at the bottom of the crown gear 25. The outer edge of the positioning disk 26 has a ring flange 47, while the inner edge thereof is a flat edge.

After the crown gear 25 is mounted on the cylindrical shaft 75 of the spindle 24, the cylindrical shaft 75 will slightly extend out beyond the inner ring surface 42, but the height thereof is slightly less than that between the surface of the flat side 46 of the positioning disk 26 and the ring flange 47. After the round hole 44 of the positioning disk 26 is mounted on the short post 45 of spindle 24, the recessed part between the short post 45 and the cylindrical shaft 75 causes a short space on the top surface of the flat side 46. After positioning disk 26 is in place, the ring 84 will press the center of the flat side 46 towards the recessed part so as to force the ring flange 47 of the positioning disk 26 against the lower surface 42 to provide a pushing force towards the inner ring surface 42 of the crown gear 25.

Figure 5:
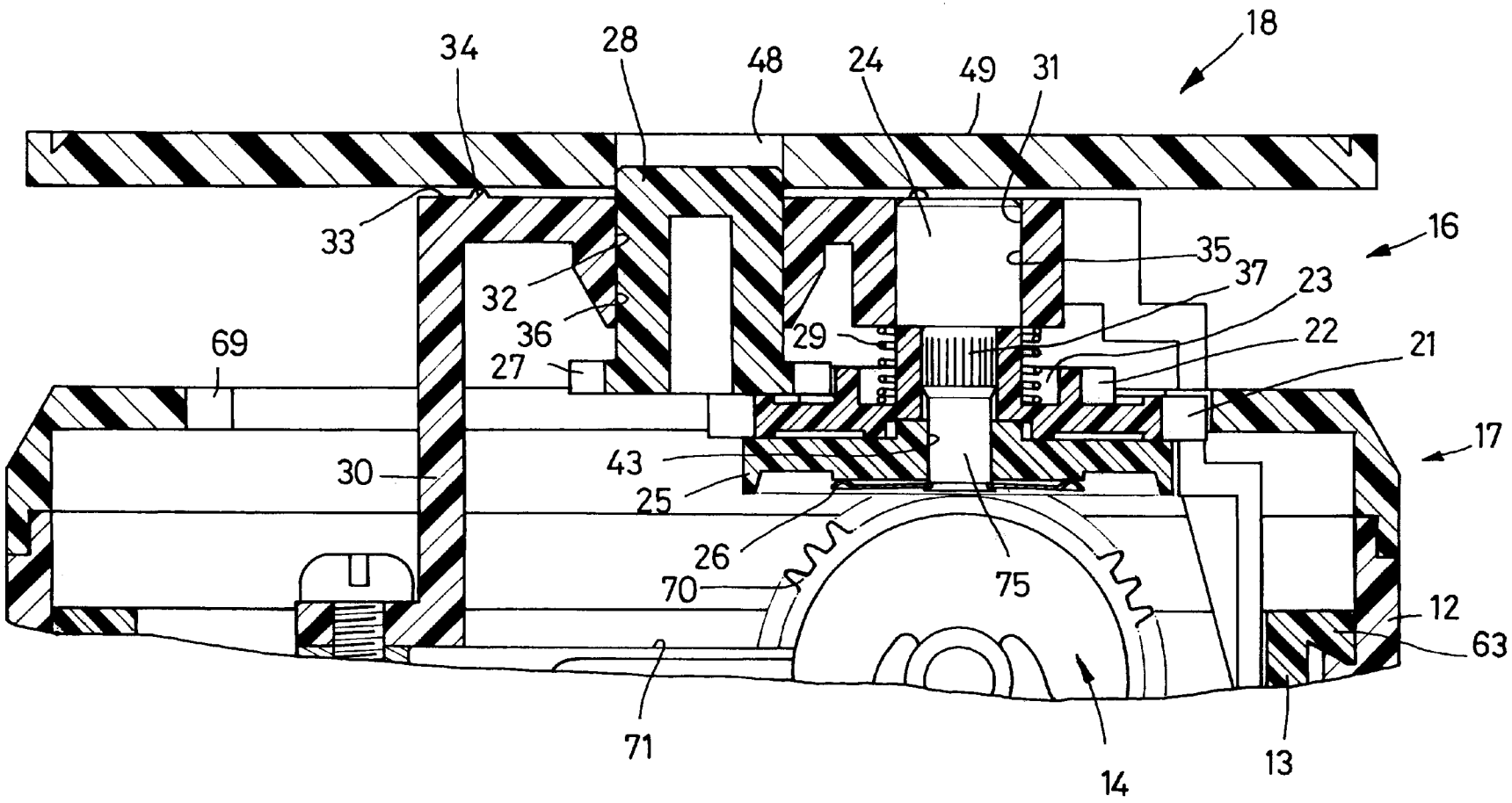
FIG. 5 is a partial, sectional view of the present invention, showing the relation between the spindles thereof.

Referring to FIGS. 2, 4 and 5, the longitudinally ridged surface 37 of the spindle 24 is pushed into the cylindrical hole 38 of the gear assembly 19 and then the cylindrical shaft 75 is mounted with the crown gear 25. After the positioning disk 26 is mounted on the short post 45 they are held together to form a single assembly. The diameter of the upper part of the spindle 24 is equal to or slightly smaller than that of the spindle hole 31 of the flat side 33 on the supporting frame 16 so as to facilitate the mounting of the spindle therein. The crown gear 25 under the spindle 24 is engaged with the driving gear 70 of the music unit 14. Then, the second transmission gear 22 will drive the driven gear 27 and the spindle 28 to move, and the rotary disk 18 on the supporting frame 16 will also be driven.

The transmission assembly 15 is mounted between the music unit 14 and the supporting frame 16. The cascade ring 67 of the cylinder part 58 on the rotary disk 12 is affixed to the ring unit 17 having an inner gear 69 which is engaged with the transmission gear 22 of the gear assembly 19. When the music unit 14 turns the crown gear 25, the first transmission gear 21 will turn the ring unit 17 thereby causing the decorative objects on the ring plate 57 of the rotary disk 12 to turn.

The spindle 28 is mounted through the center spindle hole 32 in the flat side of the supporting frame 16, and the driven gear 27 on the lower end of the spindle 28 engages the second transmission gear 22 of the gear assembly 19. The upper end of the spindle 28 extends through a round hole 48 in a rotary disk 18 above the flat side 33. The top side 49 of the rotary disk 18 has a decorative object (not shown) when the music unit 14 turns the crown gear 25, the driven gear 27 of the spindle 28 will be turned by the second transmission gear 22 of the gear assembly 19, and then the decorative objects on the top side 49 will also be turned.

Since the decorative object or objects on the top side 49 of the rotary disk 18 may have a considerably weight, it is impossible to support the object by merely the top of the first transmission gear 21 under the driven gear 27. Therefore, the flat side 33 of the supporting frame 16 has a contact flange 34 to support the bottom of the rotary disk 18 and also to support the object on the rotary disk 18 indirectly, i.e., the friction resistance between the rotary disk 18 and support surface will be reduced during rotation.

According to the present invention, the base 11 is set on a flat surface. The rotary disk 12 is mounted between the base 11 and the positioning disk 13, and the music unit 14 is mounted in the recessed space 66 in the positioning disk 13. The supporting frame 16 is mounted over the music unit 14 and the transmission assembly 15 is fastened between the supporting frame 16 and the music unit 14. The crown gear 25 engages the driving gear 70 of the music unit 14. In the gear assembly 19 above the crown gear 25, the first transmission gear 21 thereof engages the inner gear 69 of the ring unit 17 so as to transfer power to the rotary disk 12 directly and to move the object or objects on the ring plate 57. The spindle 28 is engaged with the second transmission gear 22 above the first transmission gear 21 through the driven gear 27 so as to transfer power to the rotary disk 18 and to cause the object on the rotary disk 18 to move.

In the event that the decorative object mounted on the ring plate 57 of the rotary disk 12 or the decorative object mounted on the rotary disk 18 is hindered with a resistance, the music unit 14 will stop, and no music sound will be generated. When the decorative object or objects are turned improperly, the crown gear 25 engaged with the drive gear 70 of the music unit 14 will be twisted with a force resulting in damage to the crown gear 25. The music unit 14 will be unable to transfer power to the transmission assembly 15 and the decorative objects will not move. In order to avoid the aforesaid drawback, the gear assembly 19 and the spindle 24 are connected together by means of splined surface 37, and the crown gear 25 and the gear assembly 19 are coupled together by means of a friction surface and a pushing force of the positioning disk 26 so as to increase the friction force between the crown gear 25 and the gear assembly 19. Normally, the transmission assembly would run smoothly, the friction resistance of the transmission assembly being less than that between the gear assembly 19 and the crown gear 25. When the driving gear 70 of the music unit 14 drives the crown gear 25, it will cause the related parts to move, and the decorative objects on the ring plate 57 of the rotary disk 12 and the decorative objects on the rotary disk 18 will move as well. In the event of such decorative objects being hindered with a resistance, the flat side 82 of the crown gear 25 will slide on the bottom surface 40 of the gear assembly 19 if the pushing force of the positioning disk 26 is insufficient to enable the flat side 82 of the crown gear 25 to drive the gear assembly 19 to prevent the crown gear 25 from being worn or damaged.

The embodiment of the present invention has been described in detail to disclose the features and structure thereof. It will be understood by those skilled in the art that the features and structure of the elements constituting the preferred embodiment of the present invention as described in the specification and/or illustrated in the drawings above are meant to be illustrative rather than restrictive, and that various modifications in the details and construction of the transmission structure for decorative objects may be made without departing from the scope and spirit of the invention as defined by the claims appended hereto.

What is claimed is:

1. A transmission for a decorative object having a music unit with a rotatable drum and a rotatable driving gear, a base, and a positioning disk attached to the base and supporting the music unit, the transmission comprising:

a) a supporting frame mounted on the positioning disk, the supporting frame having a first spindle hole offset from a center of the supporting frame and a second spindle hole concentric with the center of the supporting frame;

b) a first spindle rotatably located in the first spindle hole, the first spindle having a longitudinally ridged portion;

c) a gear assembly mounted on the first spindle, the gear assembly having: an opening with longitudinal ridges thereon located so as to engage he longitudinal ridged portion of the first spindle; first and second transmission gears, the number of teeth on the first transmission gear being different from the number of teeth on the second transmission gear; and a contact surface;

d) a crown gear rotatably mounted on the first spindle and engaging the driving gear;

e) biasing means acting on the gear assembly and urging the contact surface into frictional contact with the crown gear such that rotation of the crown gear is imparted to the gear assembly by such frictional contact;

f) a second spindle rotatably mounted in the second spindle hole, the second spindle having a driven gear engaging the second transmission gear such that rotation of the second transmission gear causes rotation of the second spindle;

g) a ring gear unit engaging the first transmission gear such that rotation of the first transmission gear causes rotation of the ring gear unit;

h) a first rotary disk attached to the ring gear unit so as to rotate therewith; and, i) a second rotary disk attached to the second spindle so as to rotate therewith.

2. The transmission of claim 1 further comprising a contact flange extending from the supporting frame and contacting the second rotary disk.

3. The transmission of claim 1 a portion of the first rotary disk extends around a peripheral surface of the base.

4. The transmission of claim 1 further comprising a groove formed in the contact surface of the gear assembly.

* * * * *